US005941288A

United States Patent [19]

Steiner

[11] Patent Number: 5,941,288

[45] Date of Patent: Aug. 24, 1999

[54] SHED HOLDER ELEMENT FOR THE WEAVING ROTOR OF A SERIES SHED WEAVING MACHINE

[75] Inventor: Alois Steiner, Rieden, Switzerland

[73] Assignee: Sulzer Rueti AG, Rueti, Switzerland

[21] Appl. No.: 08/981,137

[22] PCT Filed: Apr. 26, 1996

[86] PCT No.: PCT/CH96/00162

§ 371 Date: Dec. 1, 1997

§ 102(e) Date: Dec. 1, 1997

[87] PCT Pub. No.: WO96/38614

PCT Pub. Date: Dec. 5, 1996

[30] Foreign Application Priority Data

Jun. 2, 1995 [CH] Switzerland ..... 1641/95

[51] Int. Cl.[6] ..... D03D 47/00; D03C 13/00

[52] U.S. Cl. ..... 139/28

[58] Field of Search ..... 139/28, 11, 188 R

[56] References Cited

U.S. PATENT DOCUMENTS

| | | | |
|---|---|---|---|
| 2,248,461 | 7/1941 | Moessinger | 139/188 R |
| 3,075,560 | 1/1963 | Pfarrwaller | 139/188 R |
| 4,290,458 | 9/1981 | Steiner | 139/28 |
| 4,655,259 | 4/1987 | Steiner | 139/28 |

FOREIGN PATENT DOCUMENTS

| | | |
|---|---|---|
| 0 013 321 A1 | 7/1980 | European Pat. Off. . |
| 0 196 349 A1 | 10/1986 | European Pat. Off. . |
| 0 574 641 A1 | 12/1993 | European Pat. Off. . |

*Primary Examiner*—Andy Falik

*Attorney, Agent, or Firm*—Townsend and Townsend and Crew LLP

[57] ABSTRACT

The shed holder element for the weaving rotor of a series shed weaving machine comprises a weft thread channel and an upper shed support surface for warp threads. A front edge of the shed holder element leading to the support surface is executed as a sliding edge for the warp threads, which extends along a curved section over which the radius of curvature does not substantially deviate from an average value, and which has radii of curvature transverse to this curve which are greater than about the width of the shed holder element.

10 Claims, 1 Drawing Sheet

SHED HOLDER ELEMENT FOR THE WEAVING ROTOR OF A SERIES SHED WEAVING MACHINE

BACKGROUND OF THE INVENTION

The invention relates to a shed holder element for the weaving rotor of a series shed weaving machine as well as to a weaving rotor and a weaving machine with shed holder elements in accordance with the invention.

Series shed weaving machines are multiple phase weaving machines (see e.g. EP 0 013 321) in which several weft threads displaced stepwise with respect to one another are inserted into travelling sheds, with a weaving rotor forming a plurality of sheds, each of which extends over the entire cloth width. The roller-like weaving rotor has axially directed blade-like combs with beat-up blades and/or guide blades. Shed holder members are placed alternately between the guide blades and determine the upper and lower shed positions of the warp threads.

Shed holder elements are known from EP 0 196 349, each of which has a warp thread guidance section which consists of a passage between two projections, with the base of the passage forming the high shed support for the warp threads. The projections have the function of the above-mentioned guide blades. The weft insertion is done by means of air. For some individual shed holder elements a form is provided in such a manner that space remains free for an auxiliary blower nozzle.

In known shed holder elements weaving errors continually arise if, for example, a warp thread cannot be moved correctly when a change is to be made from the upper to the lower shed position. Such a faulty movement is to be ascribed to an inadequately executed form of the shed holder elements.

SUMMARY OF THE INVENTION

The object of the invention is therefore to improve the form of the shed holder elements in such a manner that weaving errors are avoided as far as possible.

DESCRIPTION OF THE SPECIFIC EMBODIMENTS

Figure 1:
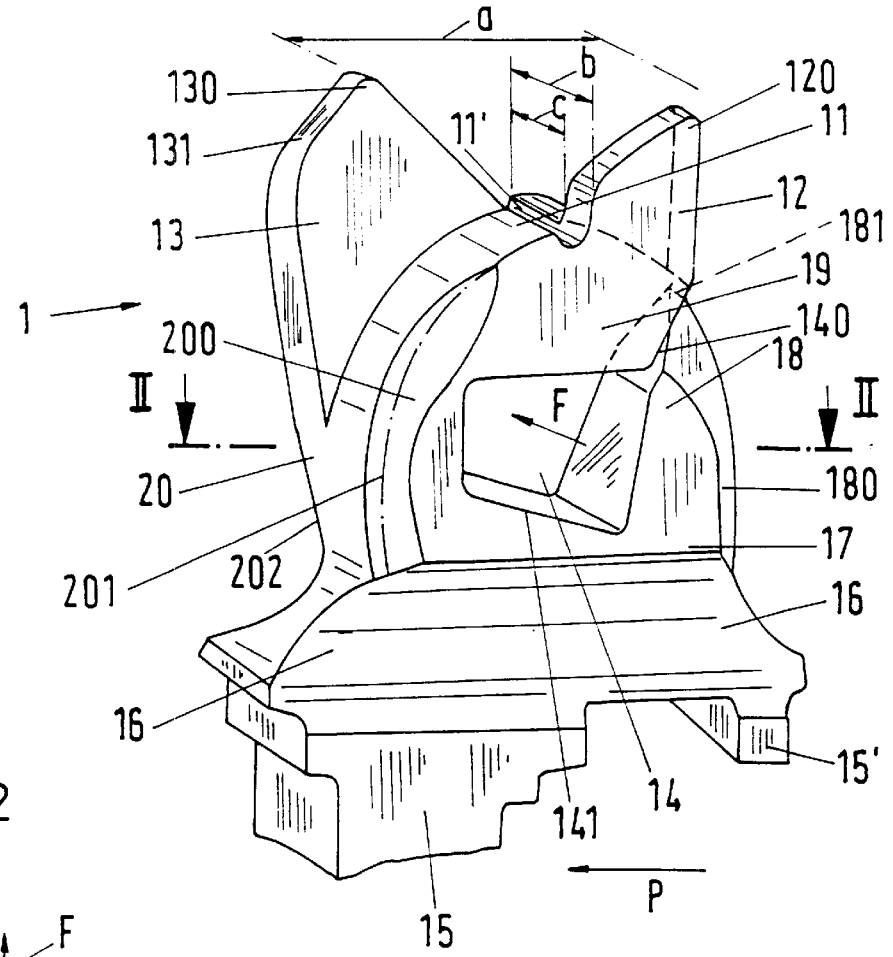
FIG. 1 is a perspective view of the upper part of a shed holder element in accordance with the invention.

The shed holder element shown in FIG. 1 has a width b which, in comparison with the length a, is shown too large in the figure. This width b amounts to about 2 mm, whereas the distance a is about 10 mm long.

Figure 3:
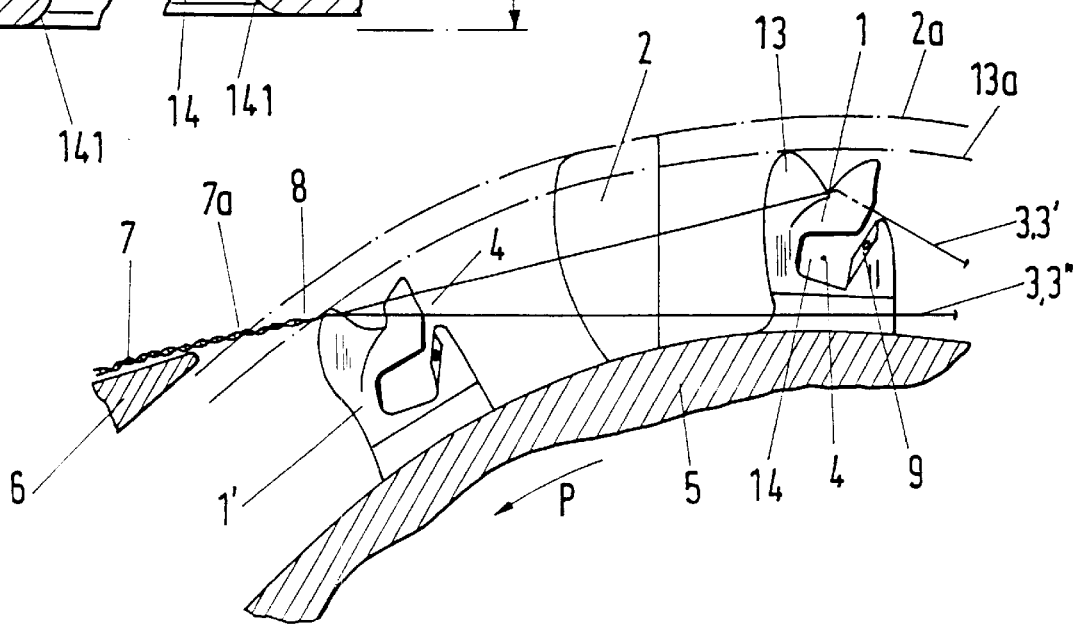
FIG. 3 shows a section of a weaving rotor viewed in the direction of the rotor axis.

The shed holder element 1 has the following parts: an upper shed support surface 11 for the warp threads 3, which is arranged between two ear-shaped projections 12 and 13; a weft thread channel 14 with the lateral exit opening 140 and with the direction of insertion indicated by the arrow F; and two parts 15, 15' that are not completely shown which are provided for fastening the shed holder element 1 in a weaving rotor 5 (see FIG. 3). The shed holder element 1 is moved by the weaving rotor 5 in the direction of the arrow P. The transverse groove 11' in the support surface has no functional significance and is present merely for reasons having to do with the manufacturing process.

The following additional designations are introduced for the description of the shed holder element 1 in relation to FIG. 1: lower shed zone 16, lower part 17, rear part 18, upper part 19, and front part 20. The lower part 17 includes the lower shed zone 16.

Figure 2:
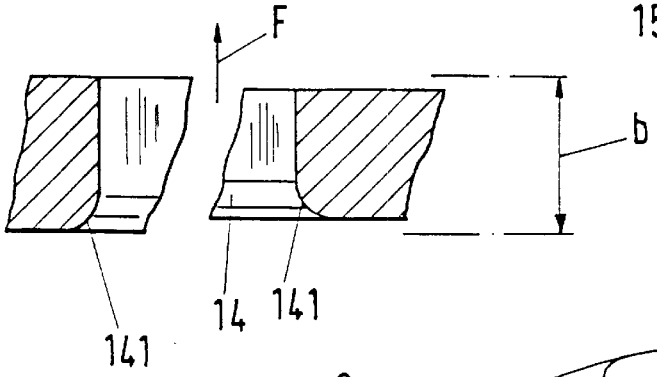
FIG. 2 is a cross-section along the line II—II in FIG. 1.

All edges shown in solid lines in FIG. 1 are to be imagined as rounded off. The edge 141 is in particular strongly rounded off at the entry side of the weft thread channel 14, as can be seen in FIG. 2.

In addition to two shed holder elements 1 and 1' fastened to the weaving rotor 5, FIG. 3 shows a beat-up blade 2 placed between them. The points of the beat-up blade 2 and of the shed holder elements 1 lying furthest outwards move along the circles 2*a* and 13*a* respectively. The warp threads 3 in the upper shed position are designated with 3', those in the lower shed position with 3". In shed holder elements 1 the weft thread 4 is located in the weft thread channel 14; in shed holder elements 1' it is located outside and in that position from which it can be beat up against the cloth edge 8 of the fabric 7 by the beat-up blades 2. The pre-cloth 7*a*, which lies between a support surface 6 and the cloth edge 8, experiences a temporary displacement into a position above the support area 6 during the beating up. The pre-cloth 7*a* springs back again from this position.

In accordance with the invention, a front edge leading to the support surface 11 is executed as a sliding edge 200 for the warp threads at the front part 20 of the shed holder element 1. This edge 200 extends along the curve section 201, over which the radii of curvature do not deviate substantially from an average value, so that the greatest radius of curvature is not larger than about ten times that of the smallest one. As a result there is no nose-like elevation at the edge 200 which could be detrimental to the movement of the warp thread 3 during a change from the upper to the lower shed position. Transverse to the curve section 201 the radii of curvature of the sliding edge 200 are relatively small, but larger than the width b of the shed holder element 1. Thanks to the special form given to the sliding edge 200, jumping or snagging of the warp thread does not occur.

The projections 12 and 13 are shown in FIG. 1 as "ears" which have a constant thickness. It is advantageous to provide a form in which each of these ears 12 and 13 tapers in the upper region towards the tips 120 and 130 respectively. In order to obtain more room for the warp threads 3 on the support surface 11, a contraction can also be provided in the reverse direction in the lower region of the ears 12 and 13 so that the width of the support surface 11 is greater than the width c given in FIG. 1. These form variants with tapers above and/or below are not shown in the Figures.

The rear part 18, formed in the shape of a tooth whose tip is blunt, tapers towards the upper part 19, which has the width b. The base of the rear part 18 has the same width b. Thus there is a backward jump from the upper part 19 to the rear part 18 at the opening 140, thanks to which a hooking in of the warp thread 3 does not occur during the change from the upper to the lower shed position.

The distance between the tips 120 and 130 measured parallel to the surface of the weaving rotor 5 is the length a in FIG. 1. This distance a is larger than in known shed holder elements. Since the distance a together with the angular velocity of the weaving rotor determines a minimum time measure for the laying-in of the warp threads, the weaving process can be performed at a higher weaving speed if a greater distance a is present. The distance a is at least about five times greater than the width b.

The front projection 130 has a "recessive" front surface 131 at its upper region which is directed in substantially the same manner as the upper part of the curved section 201. This is advantageous with respect to the above mentioned, movement of the pre-cloth 7*a*, which is caused by the beat-up blades 2. In previous forms of the shed holder element, disturbances resulted from hooking in of the front projection 130 at the pre-cloth 7*a* when it is springing back. With the form shown in FIG. 1 such a hooking in does not occur.

The lower part 17 of the shed holder element 1 has a waist in the lower shed zone 16. The waist provides additional space for the warp threads 3", whereby obstructions and frictions between the warp threads 3" are reduced.

Like the front part 20, the rear part 18 has yarn-friendly (i.e. non-abrading) rounded bevels 180 at the sliding edge 200. A corresponding non-abrading bevel is also provided for the second edge 202 of the front part 20 at the height of the weft thread channel 14.

In FIG. 3 the direction of motion of the weft thread 4 is contrary to that of FIG. 1 (arrow F). The transport of the weft thread 4 through the weft thread channel 14 is assisted by auxiliary blower nozzles 9. These auxiliary blower nozzles 9 are, as can be seen in FIG. 3, integrated into the rear parts 18 of the individual shed holder elements 1.

Shed holder elements 1 can also be used in which only one of the projections 12 or 13 is executed as a guide member for the warp threads 3. The other can be completely absent; or there can be merely a small stump provided for the purpose of producing a stable support surface 11.

The shed holder element 1 described is a monolithic construction. It can be manufactured of ceramic material. It is however advantageous to machine it out of a piece of metal.

I claim:

1. A shed holder element for a weaving rotor of a series shed weaving machine, the shed holder element having an upper shed support surface for warp threads and defining a weft thread channel, the shed holder element including a front edge leading to the support surface and being executed as a sliding edge for the warp threads, the front edge extending along a curved section of the shed holder element, the curved section having radii of curvature which do not substantially deviate from an average value, the curved section being also curved in a transverse direction and having transverse radii of curvature transverse to the curved section which are greater than about the width of the shed holder element.

2. A shed holder element in accordance with claim 1 wherein the shed holder element has a tooth-like shaped rear part which tapers in an upward direction to form a rear boundary of the weft thread channel.

3. A shed holder element in accordance with claim 2 wherein the tooth-like shaped rear part includes an auxiliary blower nozzle integrated therein.

4. A shed holder element in accordance with claim 1 wherein the shed holder element includes two projections each having a tip, the upper shed support surface for the warp threads being arranged between the two projections, the tips of the two projections defining a distance therebetween which is at least about five times larger than the width of the shed holder element.

5. A seed holder element in accordance with claim 4 wherein one of the two projections is a front projection having a front face in an upper region thereof, the front face of the front projection being oriented in substantially the same manner as an upper part of the sliding edge.

6. A shed holder element in accordance with claim 1 wherein the shed holder element includes a lower part having a waist-like lower shed zone disposed below the weft thread channel.

7. A shed holder element in accordance with claim 1 wherein the shed holder element includes a front part and a rear part disposed on opposite sides of the weft thread channel, the front part and the rear part including outer edges which have non-abrading rounded bevels along a height of the weft thread channel.

8. A shed holder element in accordance with claim 1 wherein the shed holder element is metallic.

9. A weaving rotor for a series shed weaving machine, the weaving rotor including a plurality of shed holder elements, each of the plurality of shed holder elements having an upper shed support surface for warp threads and defining a weft thread channel, the shed holder element including a front edge leading to the support surface and being executed as a sliding edge or the warp threads, the front edge extending along a curved section of the shed holder element, the curved section having radii of curvature which do not substantially deviate from an average value, the curved section being also curved in a transverse direction and having transverse radii of curvature transverse to the curved section which are greater than about the width of the shed holder element.

10. A series shed weaving machine comprising a weaving rotor which includes a plurality of shed holder elements, each of the plurality of shed holder elements having an upper shed support surface for warp threads and defining a weft thread channel, the shed holder element including a front edge leading to the support surface and being executed as a sliding edge for the warp threads, the front edge extending along a curved section of the shed holder element, the curved section having radii of curvature which do not substantially deviate from an average value, the curved section being also curved in a transverse direction and having transverse radii of curvature transverse to the curved section which are greater than about the width of the shed holder element.

* * * * *